United States Patent [19]

Nelson

[11] Patent Number: 4,500,861

[45] Date of Patent: Feb. 19, 1985

[54] SECTOR MOTOR HAVING LATCHING MEANS FOR ROTOR IN MULTIPLE POSITIONS

[76] Inventor: Victor H. Nelson, 10 Redwood Dr., Dix Hills, N.Y. 11746

[21] Appl. No.: 467,244

[22] Filed: Feb. 17, 1983

[51] Int. Cl.[3] ..... H01V 7/08

[52] U.S. Cl. ..... 335/253; 335/254

[58] Field of Search ..... 310/36, 38, 37, 67 R; 335/229, 230, 253, 254, 272

[56] References Cited

U.S. PATENT DOCUMENTS

| | | | |
|---|---|---|---|
| 3,375,512 | 3/1968 | Watkins et al. | 335/272 X |
| 3,553,619 | 8/1968 | Skrobisch | 335/272 |
| 3,735,303 | 5/1973 | Harden | 335/272 |
| 3,855,560 | 12/1974 | Ward | 335/253 X |

FOREIGN PATENT DOCUMENTS

| | | | |
|---|---|---|---|
| 1294522 | 5/1969 | Fed. Rep. of Germany | 335/272 |

*Primary Examiner*—George Harris

*Attorney, Agent, or Firm*—Edward H. Loveman

[57] ABSTRACT

A sector motor has a rotor which is rotatable to one of three positions in a housing. The rotor carries field magnets surrounding stationary armature poles carried by the housing. An arcuate 90° slot in one end of the housing receives an arcuate 45° arm projecting from the rotor thereby limiting the rotor to a total angular rotation of 90°. Spaced latching magnets coact in mutual repulsion or attraction or both to latch the rotor at either end of rotor rotation. The motor's inherrent magnetic restoring force assisted by a magnetic detent carried by the housing and rotor and located midway between opposite ends of the 90° slot latch and prevent vibration of the rotor in a central position between opposite ends of its range of rotation.

10 Claims, 11 Drawing Figures

SECTOR MOTOR HAVING LATCHING MEANS FOR ROTOR IN MULTIPLE POSITIONS

This invention relates to the art of sector motors and more particularly concerns a sector motor rotatable to one of three positions with latching means for holding the motor in any of these positions after the power has been removed therefrom, and more specifically concerns a sector motor of the type described wherein the positions are located at opposite ends of a limited angular range of movement and at a center position midway between the ends.

The invention involves improvements over the sector motors such as those described in U.S. Pat. Nos. 3,761,851, and 3,970,980. These prior art sector motors use an inherent magnetic torque to hold a rotorary armature or field magnet in one of two positions against a stop. In the motor of U.S. Pat. No. 3,970,980, an arcuate slot is provided in one end of the motor casing such that opposite ends of the slot serve as stop members when contacted by an arm carried by the rotor. However, neither the sector motor of U.S. Pat. No. 3,761,851, nor the sector motor of U.S. Pat. No. 3,970,980, latch the respective rotor in any one of three different positions after the electrical power is removed from the motor windings.

It is desirable to provide a three position sector motor which is magnetically latched in each of the three positions when power is removed from the rotor windings. When the sector motor is used for space application, it is essential to simplify the circuit and associated structure to insure foolproof, positive operation on the motor will remain over long periods of time when the power is turned off. It is also necessary that the latching of the rotor of the apparatus at each stopping position be exact, without chattering, rebounding, and vibration at the time of stopping, and thereafter, while the rotor remains in latched position.

It is therefore a principal object of the present invention to provide a sector motor with latching means for holding the rotor in a fixed position at opposite ends of a limited angular range of movement thereinbetween.

It is a further object of the present invention to provide a sector motor of the type described wherein supplementary magnets carried by the stator coact with the motor rotor to hold the rotor in said fixed positions.

It is another object of the present invention to provide a sector motor of the type described wherein supplementary magnets carried by the rotating member coact with stationary further magnets carried by the motor stator at opposite ends of the angular range of movement of the rotor.

It is still another object of the present invention to provide a sector motor as described with magnetic detent members mounted on the motor stator and rotor to stabilize and prevent quiver of the rotor in a center position between opposite ends of its rotational range of movement.

These and other objects and many of the attendant advantages of this invention will be readily appreciated as the same becomes better understood by reference to the following detailed description when considered in connection with the accompanying drawings in which.

Figure 1:
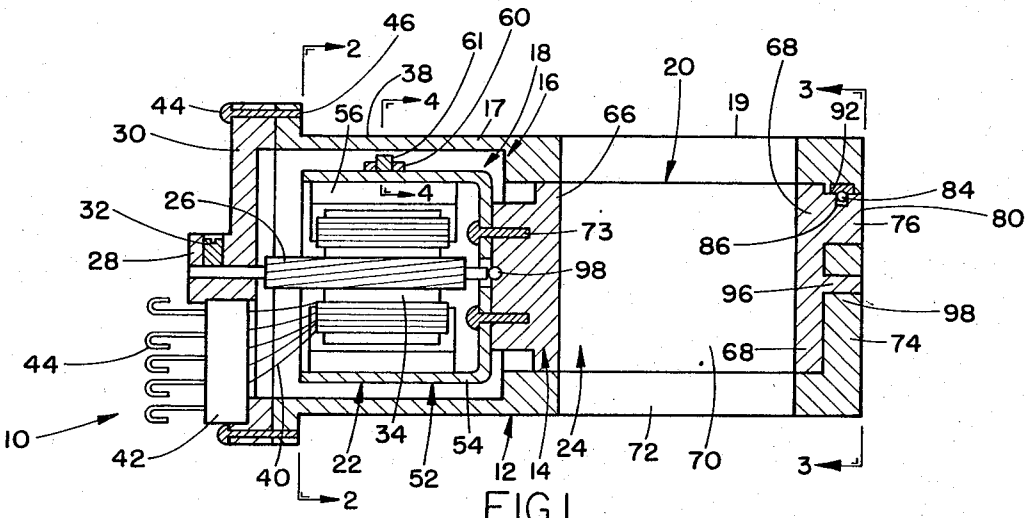
FIG. 1 is a longitudinal sectional view of a three position waveguide assembly including a sector motor embodying the invention.
Figure 2B:
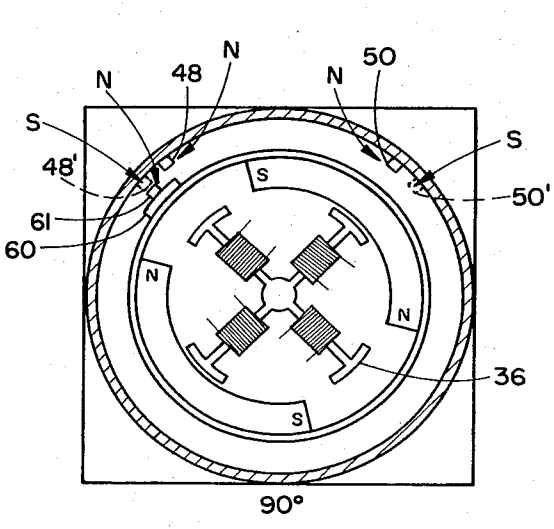
FIG. 2B is a cross sectional view similar to FIG. 2, with rotor shown in latched, end of travel or 90° position, rotated 45° counterclockwise from the position of FIG. 2.
Figure 2A:
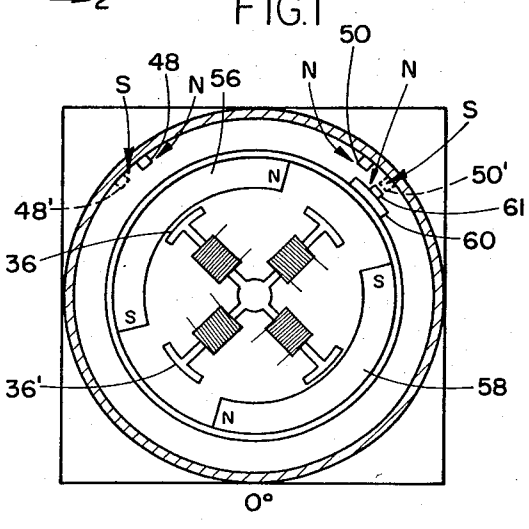
FIG. 2A is a cross sectional view similar to FIG. 2, with the rotor shown in latched, end of travel, or 0° position, rotated 45° clockwise from the position of FIG. 2.
Figure 2:
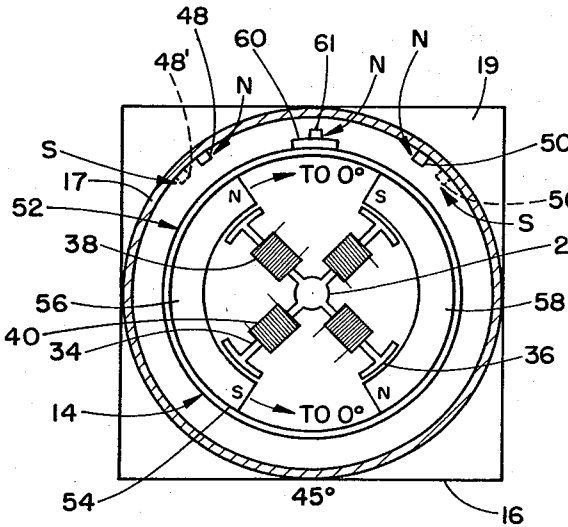
FIG. 2 is an enlarged cross sectional view taken along line 2—2 of FIG. 1, with a rotor shown in latched, midway or 45° position and magnetically stable.
Figure 4:
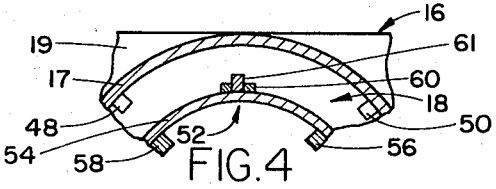
Figure 5:
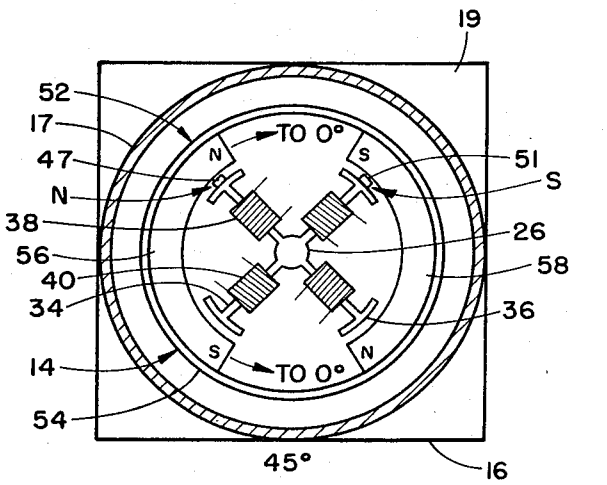
Figure 5A:
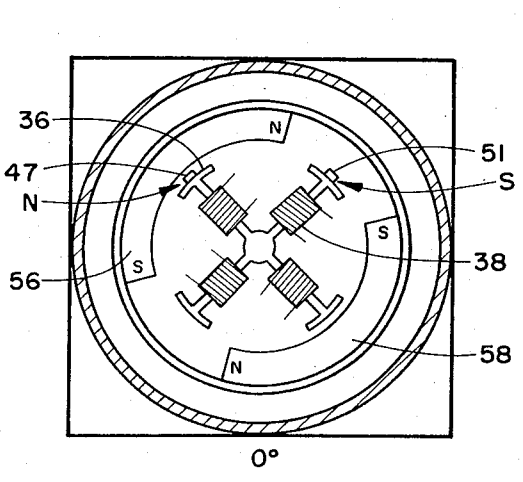
Figure 5B:
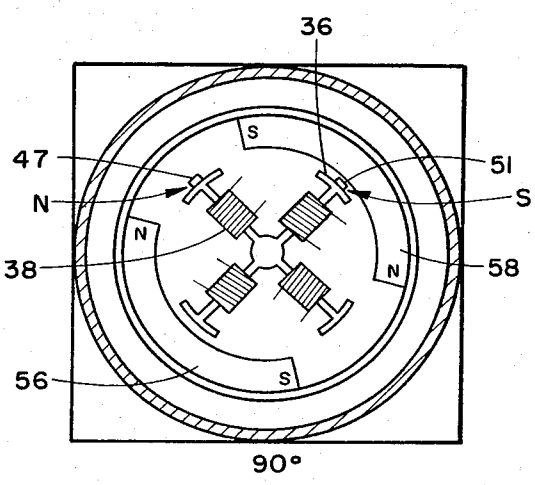

FIG. 4 is an enlarged fragmentary cross sectional view taken along line 4—4 of FIG. 1; and FIGS. 5, 5A and 5B are end views of the assembly similar to FIGS. 2, 2A and 2B but with a pair of supplemental magnets 47 and 51.

Referring now to the drawing wherein like reference characters designate like or corresponding parts throughout, there is illustrated in FIGS. 1–4 a motor driven microwave waveguide switch assembly generally designated as reference numeral 10 and comprising a stator 12 and rotor 14. The stator 12 comprises a hollow housing 16 having a cylindrical section 17 and rectangular section 19 containing cylindrical, axially aligned chambers 18 and 20 in the sections 17 and 19 respectively. The rotor 14 extends axially through both of the chambers 18, 20. A sector motor 22 is located for the most part in the chamber 18 and a microwave switch 24 is located in the chamber 20.

The motor 22 comprises a stationary armature including a stationary shaft 26 extending axially of the chamber 18. One end of the shaft 26 is secured in a nipple 28 at the outer side of a circular cap 30 closing the outer end of the chamber 18. A set screw 32 holds the shaft stationary and in place. Integral with the shaft 26 are four radially extending poles 34 spaced 90° apart circumferentially of the chamber 18. The poles 34 carry circumferentially extending pole pieces 36 at their outer ends. The poles 34 and the pole pieces 36 are integral with the shaft 26 and are made of a magnetizable material such as soft iron or the like. Wound on the poles 34 are insulated wire windings 38 whose leads 40 are connected to an insulated terminal block 42 set in an opening in the end cap 30. Circuit terminals 44 connected to the wire leads 40 extend outwardly of the block 42 and may be connected to an external power supply circuit (not shown). The cap 30 is held in place by screws 44 attached to an annular flange 46 at the left end of the housing 16, as viewed in FIG. 1. Secured to the inner side of the housing 16 in the chamber 18 are two small permanent magnets 48 and 50 spaced apart slightly less than 90° circumferentially of the chamber 18 to serve as latching members (FIGS. 2, 2A & 2B & 4).

The rotor 14 comprises a cupshaped member 52 having a cylindrical wall 54 axially aligned with the axis of the chamber 18 in which the cup 52 is rotatably disposed. Inside the cylindrical wall 54 are two cylindrically curved permanent magnets 56, 58, FIGS. 2, 2A and 2B, each extending approximately 135° circumferentially of the chamber 18 and spaced apart equally.

The magnets 56, 58 are oppositely polarized with the N pole of one magnet opposing the S pole of the other magnet and vice versa. Located between the magnets 56, 58 on the outer side of the wall 54 is a bar or plate 60 carrying a radially extending permanent magnet 61. The N pole of the magnet 61 may be radially outermost. The magnets 56 and 58 may present N poles inwardly of the chamber 18.

The rotor 14 further includes a rotary microwave switch member including two disks 66, 68 integral with a vane or vanes 70 which define passages for microwaves inside the chamber 20 communicating with four rectangular openings 72 at the four sides of the housing section 19, depending on the rotational position of the rotor 14 in the housing 16. The cup shaped member 52 is secured by screws 73 to the disk 66.

Figure 3:
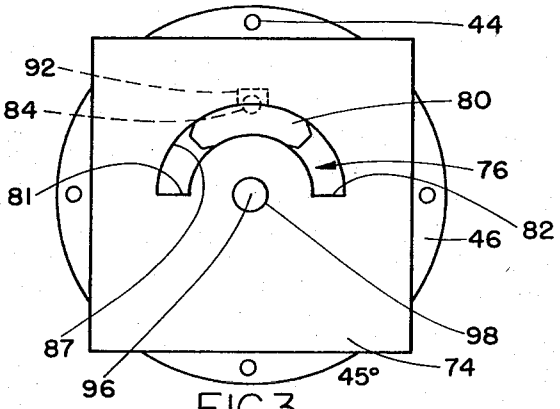
FIG. 3 is an enlarged end view of the assembly taken along line 3—3 of FIG. 1, showing stop arm in latched center or 45′ position corresponding to the rotor position of FIG. 2.
Figure 3A:
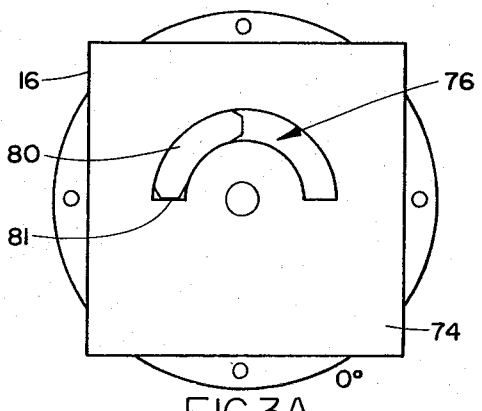
FIGS. 3A and 3B are end views of the assembly similar to FIG. 3, showing the stop arm in 0° and 90° angular rotational positions corresponding to the rotor positions of FIGS. 2A and 2B respectively.
Figure 3B:
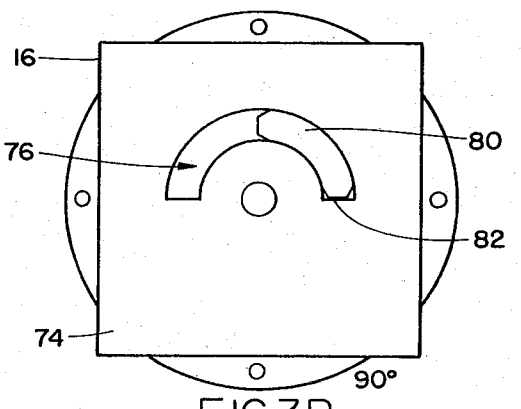

In an end wall 74 of the housing 16 is an arcuate slot 76 extending 180° circumferentially of the rotor axis (FIGS. 3, 3A, and 3B). An arcuate arm 80 extends axially outward at the right end of the rotor 14 as viewed in FIG. 1. This arm extends 90° circumferentially of the rotor axis, inside of the slot 76, and limits the rotor 14 to turning 90° between a pair of stops 81, 82 at opposite ends of the slot 76. When the rotor 14 is in the center position, between the stops 81 and 82, as illustrated in FIGS. 2 and 5, and no current applied to the windings 38 there is no rotational torque exerted on the rotor 14. Thus, the rotor 14 can quiver or vibrate very easily in this position. In accordance with the invention, a magnetic detent is provided to enhance the middle position of the rotor 14 and prevent the rotor from vibrating. The latch comprises a magnetizable ball 84 in a recess 86 in the arm 80, and is attracted outwardly to a magnet 92 in the endwall 74 midway between the stops 81 and 82 as illustrated in FIG. 3. The magnet 92 has a recess to engage and attract the ball 84 partially out of the recess 86 when the rotor 14 is in center or 45° position as indicated in FIGS. 1, 2, and 3, in which position the ball 84 operates as a detent to stabilize the rotor 14. A stub shaft 96 is rotatably engaged in a hole 98 in the end wall 74 of the housing 16 for supporting the rotor 14 which is further rotatably supported by the disks 66, and 68 in the housing section 19. The inner end of the stationary shaft 26 abuts a ball bearing 98 set in the disk 66.

In operation of the assembly when in the middle position, the rotary field magnets 56, 58 assume the position shown in FIG. 2 which locates the arm 80 midway in the slot 76 between the stops 81, 82 as shown in FIG. 3. At the same time, the rotor 14 is stabilized by engagement of the magnetizable ball 84 in the recess of the magnet 92. The rotor 14 is prevented from vibrating in this center, midway or 45° position and is held stationary thereby keeping the microwave waveguide switch members stationary in the chamber 20.

If the polarity of the armature poles 34 is changed, the rotor 14 will rotate. Depending on which windings 38 are energized by applying electrical power thereto the rotor 14 will rotate clockwise or counterclockwise when the armature pole polarities change. The rotor 14 turns clockwise when two pole pieces 36' are made S poles as indicated in FIG. 2A. The rotor 14 will turn only 45°, at which time the arm 80 will abut the stop 81 at the left end of the slot 76 as viewed in FIG. 3A. The latching magnets 61 and 50 then coact. If magnets 61 and 50 are both N poles, they will repel each other. The rotor will turn to locate magnet 61 just beyond the magnet 50 as shown in FIG. 2A. This is the end of the limited 90° range of rotation of the rotor 14, herein designated 0° position. This is inherently an unstable position of the rotor 14 since two armature pole pieces 34 are then located near the centers of the magnets 56, 58 while the other two pole pieces 34 are located between adjacent ends of the magnets 56, 58. However, the latching magnets 61 and 50 will hold the rotor 14 in stationary, latched immovable position when the electrical power is removed from the coils 38.

If the polarity of the armature windings 38 are reversed, so that only two poles 36' become N poles, magnets 56, 58 will be respectively repelled and attracted to rotate the rotor 14 counterclockwise to the position of FIG. 2B. The rotor 14 is then stopped by the abutment of the arm 80 against the stop 82 as shown in FIG. 3B. At this time, the rotor 14 becomes latched by coaction of the magnets 61 and 48. The magnets 61 and 48 tend to repel each other keeping the rotor in the 90° position.

It is possible to locate the magnets 48 and 50 slightly more than 90° apart circumferentially of the chamber 18 as indicated by magnets 48' and 50' shown in FIGS. 2, 2A and 2B. If the polarities of the magnets 48' and 50' are also changed to S poles then the magnet 61 will be attracted to the pole 50' or 48' when the rotor 14 is in either the 0° or 90° position, respectively. This will serve to latch the rotor 14 in these two end of rotation positions.

It is also possible to located a magnet 47 and a magnet 51 on the armature pole pieces 36 as illustrated in FIGS. 5, 5A, and 5B. In this embodiment, however, the magnet 47 is a N pole and the magnet 51 is a S pole. Thus, as illustrated in FIG. 5, when the rotor 14 is in the center position and power has been removed from the windings 38, the magnetic repelling force produced between the magnet 47 and the N pole of magnet 56 is counterbalanced by the magnetic repelling force between the magnet 51 and the S pole of magnet 58 thereby assisting the magnetizable ball 84 in latching the rotor 14 to the center position. When the polarity of the power applied to the windings 38 on the poles 34 is such that the rotor 14 will rotate to the 0° position illustrated in FIG. 5A and the power is removed from the windings 38, the rotor 14 will remain latched at the 0° position because of the magnetic attraction force between the magnet 51 and the S pole of the magnet 56.

Similarly, when the polarity of the power applied to the windings 38 is such that the rotor 14 is rotated to the 90° position illustrated in FIG. 5B and the power is removed from the windings 38, the rotor 14 will remain latched at the 90° position because of the magnetic attraction force between the magnet 51 and the N pole of magnet 58 and the magnetic attraction between the pole 47 and the S pole of the magnet 58.

By the arrangement described, the rotor 14 is latched magnetically in the end positions and in the center position. The rotor 14 turns readily away from any selected position depending on the polarities of the stationary armature field magnets 34 induced by currents selectively transmitted through the armature windings 38.

The rotor 14 is precisely positioned in each of its three positions as required by the associated microwave switch. It will be understood that the sector motor 22 is of general application and can be used for other purposes than driving a microwave switch. It should also be understood that although the invention has been described with a sector motor having a stationary actuator and rotatable field poles, the invention can obviously be used with a sector motor having a rotary armature and stationary field poles as illustrated in U.S. Pat. No. 3,761,851.

It should be understood that the foregoing relates to only a preferred embodiment of the invention which has been by way of example only, and that it is intended to cover all changes and modifications of the example of the invention herein chosen for the purposes of the disclosure, which do not constitute departures from the spirit and scope of the invention.

What is claimed is:

1. In a three position sector motor of the type having a housing an armature having a plurality of magnetic arms, each arm carrying a coil winding adapted to be selectively energized and a pair of cylindrically curved permanently magnetized pole pieces of opposite polarity circumferentially spaced apart and surrounding said armature the improvement comprising:

a mechanical stop means for limiting angular rotation of said motor; and a latching means for holding said motor in stopped positions at opposite ends of angular rotation of said motor and in a central position midway between said ends of angular rotation of said motor, when said rotor is stopped in any of said positions and said windings are de-energized.

2. A sector motor as defined in claim 1, wherein said armature is stationary and said pole pieces comprises a rotor, and wherein said latching means comprises magnet means carried by said rotor and housing and disposed to react to keep said rotor in latched, stopped position at opposite ends of angular rotation of said rotor.

3. A sector motor as defined in claim 2, wherein said magnet means comprises two other magnets spaced apart on said housing, and a third magnet carried by said rotor between said two other magnets for coaction with said two other magnets to keep said rotor in latched positions at opposite ends of its angular rotation.

4. A sector motor as defined in claim 3, wherein said two other magnets and said third magnet have the same polarity so that said third magnet is repelled by one of said two other magnets at each end of angular rotation of said rotor.

5. A sector motor as defined in claim 3, wherein said two other magnets have the same polarity and said third magnet has opposite polarity so that said third magnet is attracted by one of said two other magnets at each end of angular rotation of said rotor.

6. A sector motor as defined in claim 3, wherein said two other magnets are spaced apart circumferentially of said rotor less than the angular range of rotation of said rotor.

7. A sector motor as defined in claim 5, wherein said two other magnets are spaced apart circumferentially of said rotor more than the angular range of rotation of said rotor.

8. A sector motor as defined in claim 2, wherein said latching means further comprises stabilizing detent means carried by said rotor and housing and disposed to engage and hold said rotor in latched position between said opposite ends of angular rotation of said rotor.

9. A sector motor as defined in claim 1, wherein said mechanical stop means comprises:

an arcuate 90° slot formed in an end wall of said casing, and an arm carried by said rotor extending into said slot, said arm extending 45° circumferentially of said slot so that rotor is limited to 90° in angular rotation in said housing.

10. A sector motor as defined in claim 1, wherein said latching means comprises two permanent magnets each of opposite polarity, and each mounted on a different adjacent one of said magnetic arms.

* * * * *